US007006064B2

(12) United States Patent
Enomoto et al.

(10) Patent No.: US 7,006,064 B2
(45) Date of Patent: Feb. 28, 2006

(54) LIQUID CRYSTAL DISPLAY

(75) Inventors: Hiromi Enomoto, Kawasaki (JP); Susumu Okazaki, Kawasaki (JP); Hongyong Zhang, Kawasaki (JP)

(73) Assignee: Sharp Corporation, Osaka (JP)

( * ) Notice: Subject to any disclaimer, the term of this patent is extended or adjusted under 35 U.S.C. 154(b) by 226 days.

(21) Appl. No.: 10/102,453

(22) Filed: Mar. 20, 2002

(65) Prior Publication Data

US 2003/0095091 A1 May 22, 2003

(30) Foreign Application Priority Data

Nov. 16, 2001 (JP) ..... 2001-352349

(51) Int. Cl.
*G09G 3/36* (2006.01)

(52) U.S. Cl. ..... 345/87; 345/88; 345/89; 345/90; 345/104

(58) Field of Classification Search ..... 345/87–104, 345/204–206, 84; 315/169.3; 349/153–155, 349/42; 257/79, 347; 350/342; 359/296; 347/71
See application file for complete search history.

(56) References Cited

U.S. PATENT DOCUMENTS 4,952,031 A * 8/1990 Tsunoda et al. ..... 349/24
5,392,058 A * 2/1995 Tagawa ..... 345/104
5,430,462 A * 7/1995 Katagiri et al. ..... 345/104
5,706,022 A * 1/1998 Hato ..... 345/92
5,748,165 A * 5/1998 Kubota et al. ..... 345/96
6,078,379 A * 6/2000 Nagae et al. ..... 349/155
6,091,393 A * 7/2000 Park ..... 345/100
6,300,926 B1 * 10/2001 Yoneya et al. ..... 345/87
6,489,952 B1 * 12/2002 Tanaka et al. ..... 345/205
6,628,258 B1 * 9/2003 Nakamura ..... 345/98
2002/0008795 A1 * 1/2002 Koyama et al. ..... 349/42
2002/0075249 A1 * 6/2002 Kubota et al. ..... 345/204
2002/0149323 A1 * 10/2002 Ito ..... 315/169.3
2002/0196243 A1 * 12/2002 Morita ..... 345/204
2003/0058208 A1 * 3/2003 Kawamura et al. ..... 345/87
2003/0117464 A1 * 6/2003 Miyata ..... 347/71
2003/0151572 A1 * 8/2003 Kumada et al. ..... 345/87
2003/0201447 A1 * 10/2003 Yamazaki et al. ..... 257/79
2003/0222311 A1 * 12/2003 Kim ..... 257/347

* cited by examiner

*Primary Examiner*—Vijay Shankar
*Assistant Examiner*—Prabodh Dharia
(74) *Attorney, Agent, or Firm*—Greer, Burns & Crain, Ltd.

(57) ABSTRACT

A common electrode driving circuit is provided on a TFT substrate as a first substrate. Striped common electrodes are formed along the layout of pixels, such as data lines (or scanning lines), on a common substrate as a second substrate. The common electrode driving circuit inverts a common electrode voltage that is applied to a common electrode of an odd-number order, relative to a common electrode voltage that is applied to a common electrode of an even-number order. The common electrode driving circuit inverts these common electrode voltages to match the polarity inversion period at the same time. Based on this, a common inversion driving system is realized, and flicker is reduced according to a lengthwise line (or crosswise line) inversion driving system.

9 Claims, 8 Drawing Sheets

LIQUID CRYSTAL DISPLAY

FIELD OF THE INVENTION

The present invention relates to an active matrix type liquid crystal display that uses a thin-film transistor (TFT).

BACKGROUND OF THE INVENTION

In general, a liquid crystal display employs an alternating current (AC) driving system that alternately applies driving voltages of positive polarity and negative polarity to liquid crystal elements of each pixel for each one frame or each one horizontal period, in order to suppress deterioration of the liquid crystal. Further, the apparatus is driven in such a way as to invert the polarities of adjacent data lines or scanning lines, in order to suppress flicker that occurs due to the AC driving system.

FIG. 1 is a partially-broken perspective diagram of a conventional active matrix type liquid crystal display. FIG. 2 is a cross-section of key portions of the conventional active matrix type liquid crystal display. As shown in FIG. 1 and FIG. 2, in the conventional liquid crystal display, pixel electrodes 11 and TFT's 12 as switching elements are disposed in a matrix shape of m rows and n columns on a substrate ("TFT substrate") 1. Electrodes that are common ("common electrodes") 21 are uniformly provided substantially on the whole surface a substrate ("common substrate") 2. A liquid crystal layer 3 is sealed into between the TFT substrate 1 and the common substrate 2 by a sealing section 31. A plurality of data lines 13 and a plurality of scanning lines 14 are provided in lengthwise and crosswise on the TFT substrate 1, and the TFT's 12 are connected to these points of intersection.

According to a liquid crystal display that uses polysilicon TFT's as switching elements, usually, a part of or the whole driving circuit of the data lines 13 or the scanning lines 14 are manufactured on the TFT substrate 1, as the carrier mobility of the polysilicon TFT's is large. As shown in FIG. 1, a data line driving circuit 15 and a scanning line driving circuit 16 are provided on the TFT substrate 1. An electrode 17 that becomes an outgoing line is provided on the peripheral area of the TFT substrate 1. A common electrode voltage is applied to the common electrodes 21 via this electrode 17 and a conductor (a transfer) 18 that is connected to this electrode 17. The electrode 17 is covered with a protection film 19.

As an AC driving system of this liquid crystal display, there is a common fixed driving system that fixes a common electrode voltage to a constant value. According to this driving system, a voltage that has positive polarity and a voltage that has negative polarity relative to the common electrode voltage respectively are applied alternately to the data lines 13. In other words, the polarity of the voltage applied to the data lines 13 is inverted. As the amplitude of the voltage applied to the data lines 13 becomes large, the power source voltage of the data line driving circuit 15 becomes large. As a result, a withstanding voltage that is required for transistors, buffers, and analog switches of the data line driving circuit 15 becomes large. Further, power consumption also increases.

There is also a driving system (a common inversion driving system) that minimizes the amplitude of a voltage supplied to the data line 13, by inverting the polarity of the common electrode voltage. For example, the amplitude of a voltage applied to the data lines 13 is restricted to a range of within 5 V, and the common electrode voltage is changed to match the polarity inversion period. Based on this, it becomes possible to restrict the power source voltage of the data line driving circuit 15 to 5 V, for example. Therefore, it is possible to lower the withstanding voltage and the power consumption of the elements of the data line driving circuit 15, which is advantageous in the aspect of cost and power consumption.

However, according to the conventional liquid crystal display, the load becomes large when the sizes of the screen become large, as the common electrode 21 are provided uniformly substantially on the whole surface of the common substrate 2. Therefore, the conventional liquid crystal display has had a problem that it is difficult to inversely drive the common electrodes 21, and that flicker also occurs.

SUMMARY OF THE INVENTION

It is an object of the present invention to provide a liquid crystal display that minimizes the occurrence of flicker and that can make a high-quality display, in the liquid crystal display that uses polysilicon TFT's.

The liquid crystal display according to one aspect of the present invention comprises a first substrate on which pixel electrodes are disposed in a matrix shape of m rows and n columns, a second substrate on which a plurality of common electrodes are disposed in a stripe shape corresponding to the n columns of electrodes, a liquid crystal layer provided between the first substrate and the second substrate, a common electrode driving circuit provided on the first substrate, and which applies mutually-inverted voltages to the common electrodes of odd-number orders and to the common electrodes of even-number orders respectively, first conductors which electrically connect the common electrode driving circuit to the common electrodes of odd-number orders, in order to apply a voltage generated by the common electrode driving circuit to the common electrodes of odd-number orders, and second conductors which electrically connect the common electrode driving circuit to the common electrodes of even-number orders, in order to apply a voltage generated by the common electrode driving circuit to the common electrodes of even-number orders.

The liquid crystal display according to another aspect of the present invention comprises a first substrate on which pixel electrodes are disposed in a matrix shape of m rows and n columns, a second substrate on which a plurality of common electrodes are disposed in a stripe shape corresponding to the m rows of electrodes, a liquid crystal layer provided between the first substrate and the second substrate, a common electrode driving circuit provided on the first substrate, and which applies mutually-inverted voltages to the common electrodes of odd-number orders and to the common electrodes of even-number orders respectively, first conductors which electrically connect the common electrode driving circuit to the common electrodes of odd-number orders, in order to apply a voltage generated by the common electrode driving circuit to the common electrodes of odd-number orders, and second conductors which electrically connect the common electrode driving circuit to the common electrodes of even-number orders, in order to apply a voltage generated by the common electrode driving circuit to the common electrodes of even-number orders.

The liquid crystal display according to still another aspect of the present invention comprises a first substrate on which pixel electrodes are disposed in a matrix shape of m rows and n columns, as a second substrate on which a plurality of first common electrodes are disposed in a stripe shape corresponding to the n columns of electrodes, and also a plurality of second common electrodes are disposed in a stripe shape corresponding to the m rows of electrodes, with the first common electrodes and the second common electrodes being insulated from each other via an insulation layer, a liquid crystal layer provided between the first substrate and the second substrate, a common electrode driving circuit provided on the first substrate, and which applies mutually-inverted voltages to the first common electrodes of odd-number orders and to the first common electrodes of even-number orders respectively, or which applies mutually-inverted voltages to the second common electrodes of odd-number orders and to the second common electrodes of even-number orders respectively, first conductors which electrically connect the common electrode driving circuit to the first common electrodes of odd-number orders, in order to apply a voltage generated by the common electrode driving circuit to the first common electrodes of odd-number orders, second conductors which electrically connect the common electrode driving circuit to the first common electrodes of even-number orders, in order to apply a voltage generated by the common electrode driving circuit to the first common electrodes of even-number orders, third conductors which electrically connect the common electrode driving circuit to the second common electrodes of odd-number orders, in order to apply a voltage generated by the common electrode driving circuit to the second common electrodes of odd-number orders, and fourth conductors which electrically connect the common electrode driving circuit to the second common electrodes of even-number orders, in order to apply a voltage generated by the common electrode driving circuit to the second common electrodes of even-number orders.

According to the above-mentioned aspects, a common electrode voltage that is applied to a common electrode of an odd-number order and a common electrode voltage that is applied to a common electrode of an even-number order are inverted to match the polarity inversion period respectively, by the common electrode driving circuit. Further, the common electrode voltage that is applied to a common electrode of an odd-number order and the common electrode voltage that is applied to a common electrode of an even-number order have polarities that are inverted by the common electrode driving circuit.

Other objects and features of this invention will become apparent from the following description with reference to the accompanying drawings.

DETAILED DESCRIPTIONS

Embodiments of the liquid crystal display according to the present invention will be explained in detail below with reference to the accompanying drawings.

Figure 1:
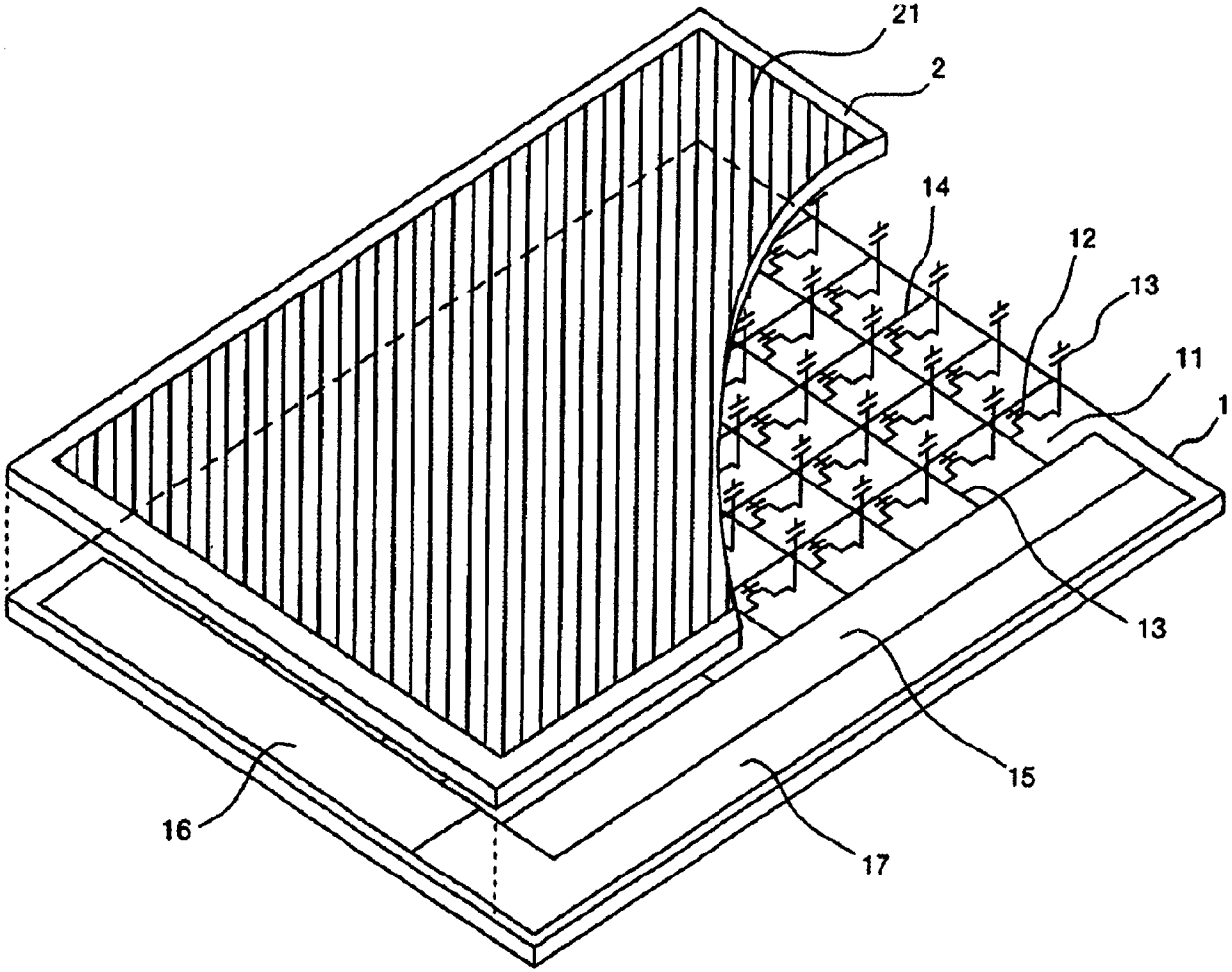
FIG.1 (PRIOR ART)
FIG. 1 is a partially broken-down total perspective diagram that schematically shows a conventional active matrix type liquid crystal display.
Figure 2:
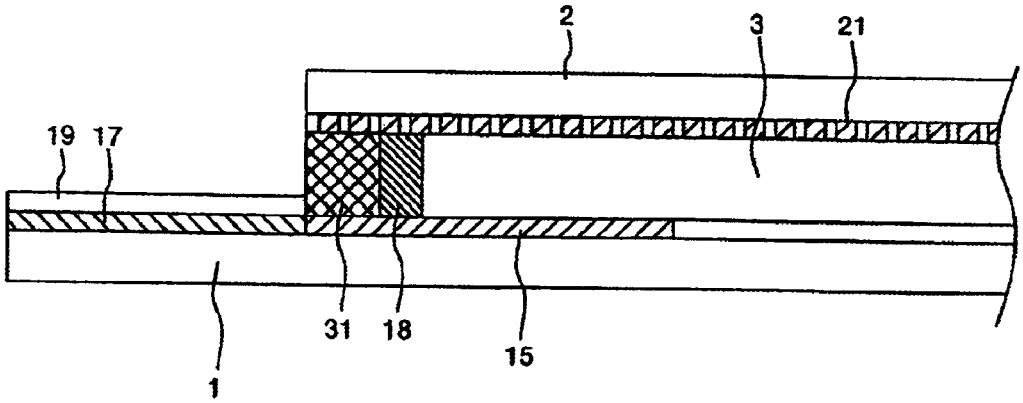
FIG.2 (PRIOR ART)
FIG. 2 is a cross-sectional diagram that schematically shows a cross-sectional structure of key portions of the conventional active matrix type liquid crystal display.
Figure 3:
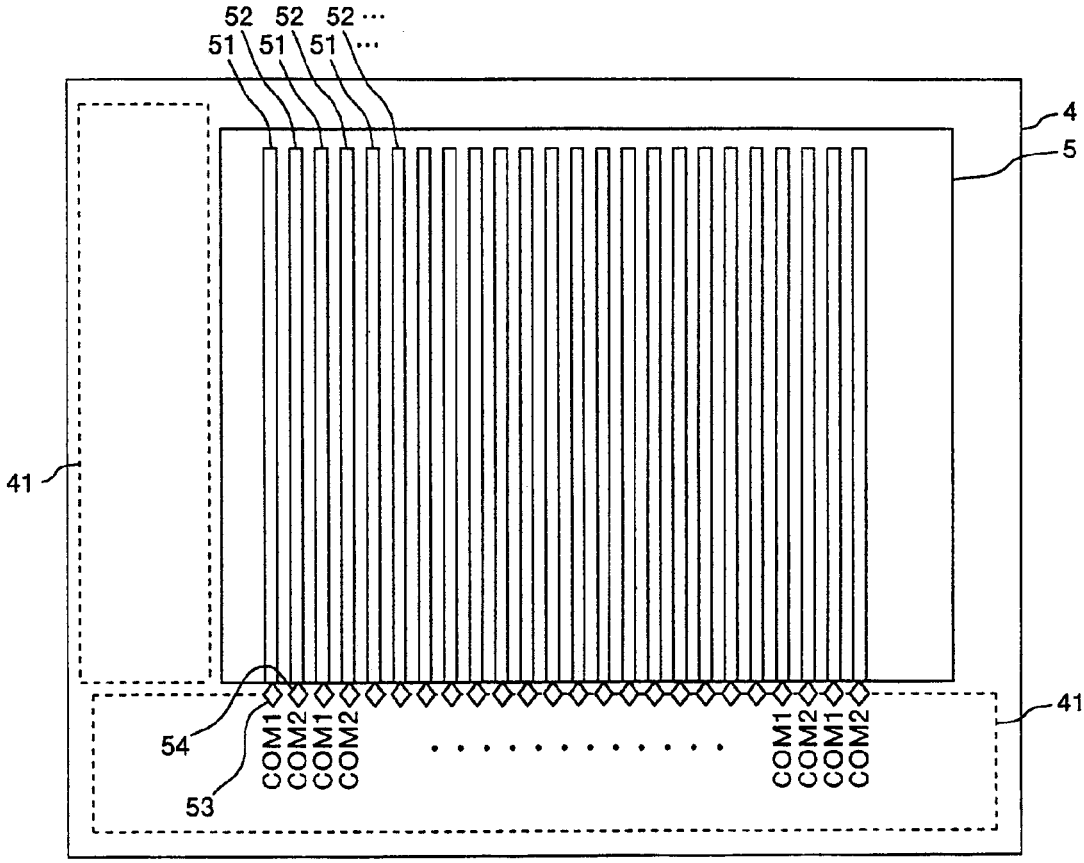
FIG. 3 is a top plan diagram that shows an outline of a liquid crystal display according to a first embodiment of the present invention.

FIG. 3 is a top plan diagram of the liquid crystal display according to a first embodiment of the present invention. As shown in FIG. 3, a display section is provided on a TFT substrate 4 as a first substrate. Although not shown, this display section has pixel electrodes and TFT's disposed in a matrix shape of m rows and n columns. On the periphery of this display section, there is disposed a control circuit section 41 that includes a data line driving circuit, a scanning line driving circuit, and a common electrode driving circuit.

On a common substrate 5 as a second substrate that faces the display section of the TFT substrate 4, there are disposed thin linear common electrodes 51 and 52 respectively along a plurality of data lines (not shown in the drawing) that are provided on the display section of the TFT substrate 4. Assume that the data lines are extended in a lengthwise direction, and a plurality of scanning lines (not shown in the drawing) that are provided on the display section of the TFT substrate 4 are extended in a crosswise direction. Then, the plurality of common electrodes 51 and 52 are disposed lengthwise in a stripe shape. Although not shown in the drawing, a liquid crystal layer is sealed into between the TFT substrate 4 and the common substrate 5.

Common electrodes of odd-number orders 51 from the left side, that is, the common electrodes of a first order, a third order, a fifth order, etc., are connected to individual first conductors (transfers) 53 respectively. The plurality of first conductors 53 are connected in common to a first output terminal, not shown, of the common electrode driving circuit that is provided on the control circuit section 41 of the TFT substrate 4. In other words, the same common electrode voltage (hereinafter, to be referred to as the COM1) is applied to the common electrodes of odd-number orders 51. Furthermore, common electrodes of even-number orders 52 from the left side, that is, the common electrodes of a second order, a fourth order, a sixth order, etc., are connected to individual second conductors (transfers) 54 respectively. The plurality of second conductors 54 are connected in common to a second output terminal, not shown, of the common electrode driving circuit. Therefore, the same common electrode voltage (hereinafter, to be referred to as the COM2) is applied to the common electrodes of even-number orders 52.

The common electrode driving circuit generates a COM1 and a COM2 that is the inverted COM1. Therefore, mutually-inverted common electrode voltages are applied to the common electrodes of odd-number orders 51 and the common electrodes of even-number orders 52 respectively. Further, the common electrode driving circuit inverts the COM1 and the COM2 at the same time in a predetermined inversion period. The inversion period is adjusted to a period in which flicker is not noticeable.

Figure 4:
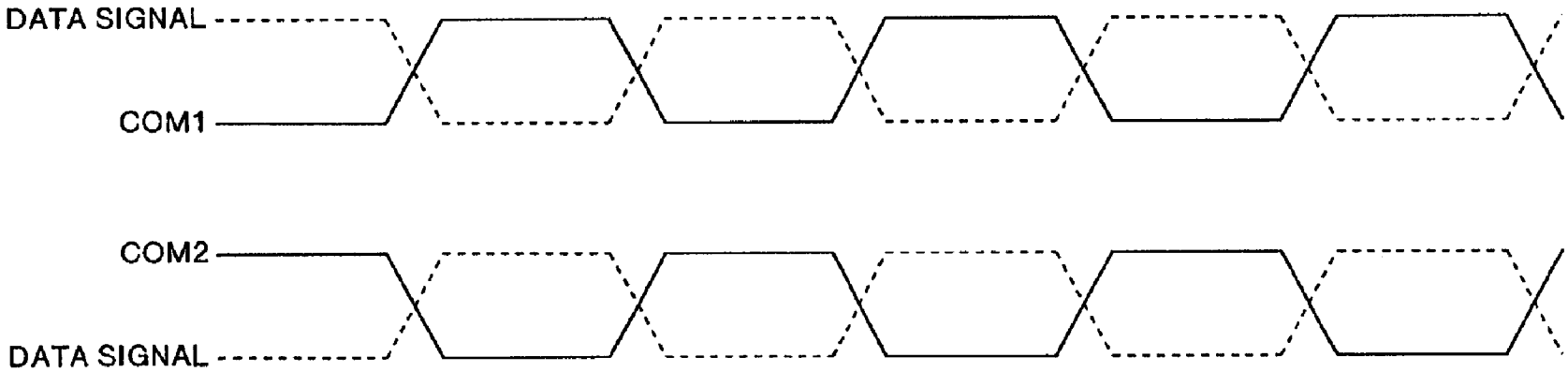
FIG. 4 is a waveform diagram that shows a status of changes in a common electrode voltage and a data signal of the liquid crystal display according to the first embodiment of the present invention.

FIG. 4 shows a status of changes in the COM1, the COM2, and a voltage applied to the data lines, that is, a change in a data signal, respectively. As shown in FIG. 4, when the COM1 is at a relatively high voltage level, the COM2 becomes at a relatively low voltage level. When the COM1 is at a relatively low voltage level, the COM2 becomes at a relatively high voltage level. These voltage levels change at the same timing. Further, when the COM1 is at a relatively high voltage level, a voltage level of a data signal corresponding to the COM1 becomes at a relatively low level and in negative polarity. When the COM1 is at a relatively low voltage level, a voltage level of a data signal corresponding to the COM1 becomes at a relatively high level and in positive polarity. The same also applies to the COM2 and a data signal corresponding to the COM2.

According to the first embodiment, as the common electrodes 51 and 52 are in thin linear shapes respectively and their loads are small, it is possible to invert the COM1 and the COM2 at the same time in a predetermined inversion period. Therefore, it is possible to realize a common inversion driving system. Based on this, it becomes possible to make smaller the amplitude of the voltage supplied to the data lines than the amplitude of the voltage in the common fixed driving system. Consequently, it is possible to construct the data line driving circuit with elements of a low withstanding voltage. As a result, it is possible to achieve a reduction in power consumption and a reduction in cost.

Further, as the COM1 and the COM2 are in a mutually inverted relationship, it is possible to realize a lengthwise line inversion driving system that applies a voltage of an opposite polarity to pixels that are adjacently disposed in a crosswise direction. Therefore, based on a simultaneous realization of the common inversion driving system and the lengthwise line inversion driving system, flicker is reduced and it becomes possible to obtain satisfactory display quality in a large-screen and high-precision liquid crystal display.

Figure 5:
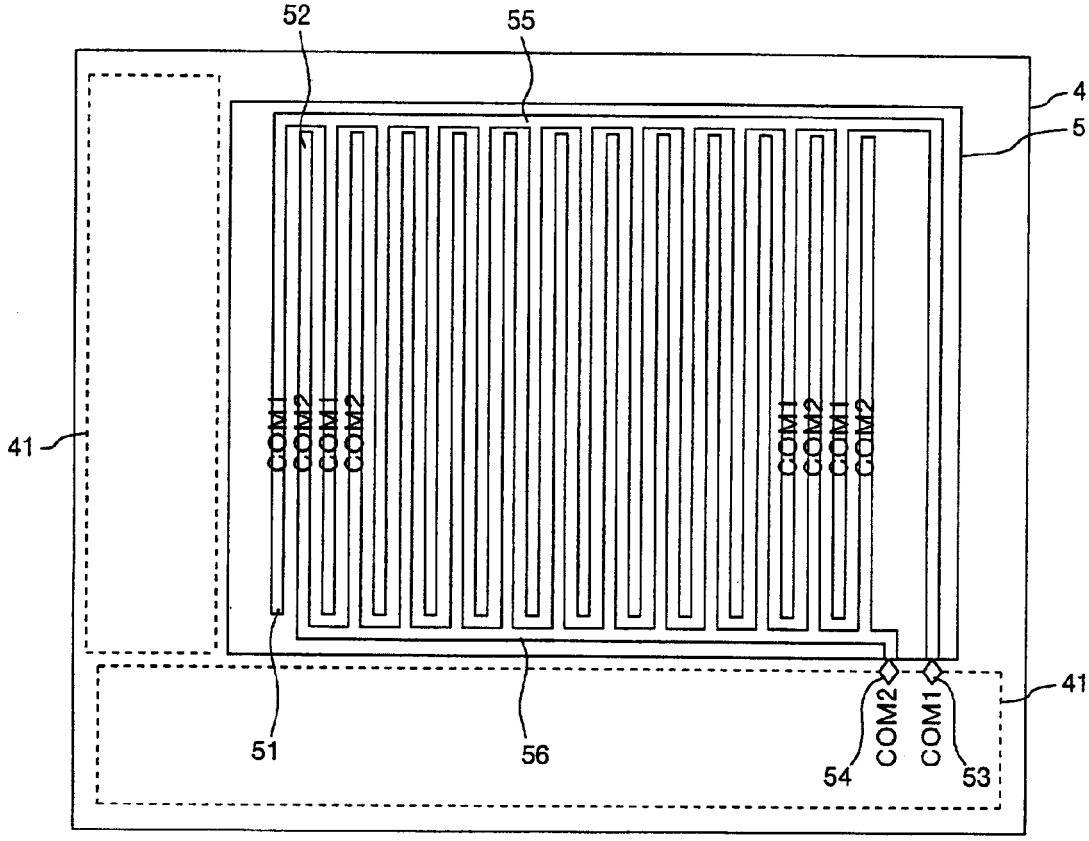
FIG. 5 is a top plan diagram that shows an outline of a modification of the liquid crystal display according to the first embodiment of the present invention.

As shown in FIG. 5, it is possible to short-circuit the common electrodes of odd-number orders 51 by connecting them with a wiring 55 on the common substrate 5, and to short-circuit the common electrodes of even-number orders 52 by connecting them with a wiring 56 on the common substrate 5. Based on this arrangement, these common electrodes 51 and 52 may be electrically connected to the common electrode driving circuit via the first conductor 53 and the second conductor 54 at about one to four positions respectively. As a result, it becomes possible to reduce the number of connection positions at which the first and second conductors 53 and 54 are used.

Figure 6:
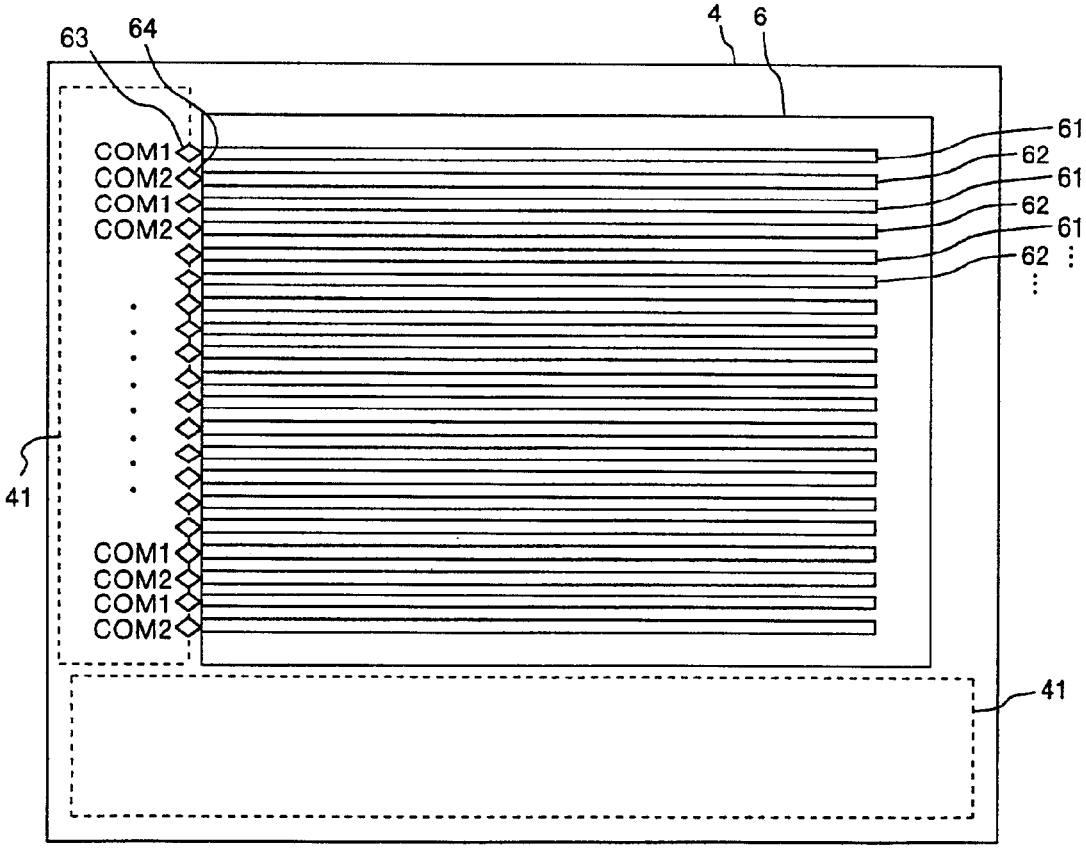
FIG. 6 is a top plan diagram that shows an outline of a liquid crystal display according to a second embodiment of the present invention.

FIG. 6 is a top plan diagram of the liquid crystal display according to a second embodiment of the present invention. The second embodiment is different from the first embodiment in that, while the common electrodes 51 and 52 are in a lengthwise stripe shape in the first embodiment, the common electrodes 61 and 62 are in a crosswise stripe shape in the second embodiment as shown in FIG. 6. On a common substrate 6 as a second substrate, there are disposed thin linear common electrodes 61 and 62 respectively along a plurality of scanning lines (not shown in the drawing) that are provided on the display section of the TFT substrate 4.

As shown in FIG. 6, common electrodes of odd-number orders 61 from the topside, that is, the common electrodes of a first order, a third order, a fifth order, etc., are electrically connected to a common electrode driving circuit provided on a control circuit section 41 of the TFT substrate 4 via individual first conductors (transfers) 63 respectively. These common electrodes 61 are applied with the COM1. Furthermore, common electrodes of even-number orders 62 from the topside, that is, the common electrodes of a second order, a fourth order, a sixth order, etc., are electrically connected to the common electrode driving circuit via individual second conductors (transfers) 64 respectively.

Other structures are the same as those of the first embodiment. Therefore, sections of the same structures as those of the first embodiment are attached with like reference numerals, and their explanation will be omitted. Further, the status of changes in the COM1, the COM2, and a voltage level of a data signal respectively is similar to that explained in FIG. 4 and the first embodiment with reference to FIG. 4. These common electrodes are applied with the COM2.

According to the second embodiment, as the common electrodes 61 and 62 are in thin linear shapes respectively and their loads are small, it is possible to invert the COM1 and the COM2 at the same time in a predetermined inversion period. Therefore, it is possible to realize a common inversion driving system. Based on this, it becomes possible to make smaller the amplitude of the voltage supplied to the data lines than the amplitude of the voltage in the common fixed driving system. Consequently, it is possible to construct the data line driving circuit with elements of a low withstanding voltage. As a result, it is possible to achieve a reduction in power consumption and a reduction in cost.

Further, as the COM1 and the COM2 are in a mutually inverted relationship, it is possible to realize a crosswise line inversion driving system that applies a voltage of an opposite polarity to pixels that are adjacently disposed in a lengthwise direction. Therefore, based on a simultaneous realization of the common inversion driving system and the crosswise line inversion driving system, flicker is reduced and it becomes possible to obtain satisfactory display quality in a large-screen and high-precision liquid crystal display.

Figure 7:
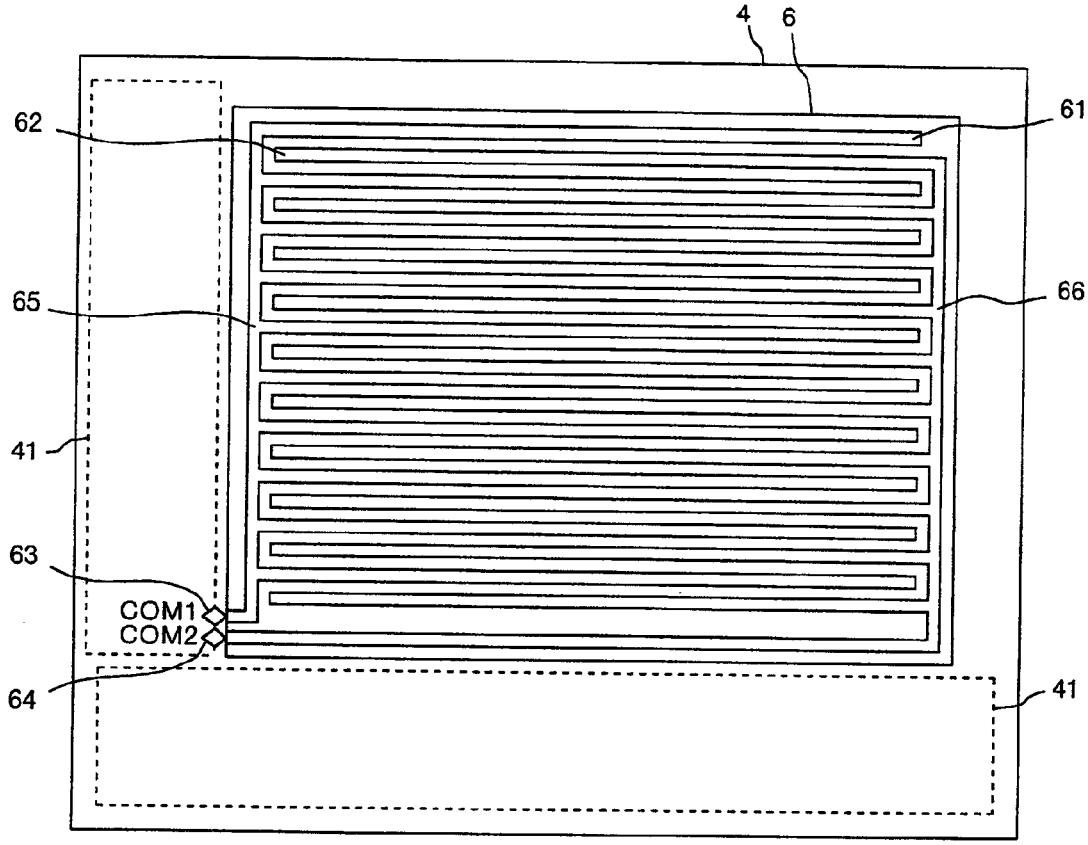
FIG. 7 is a top plan diagram that shows an outline of a modification of the liquid crystal display according to the second embodiment of the present invention.

As shown in FIG. 7, it is possible to short-circuit the common electrodes of odd-number orders 61 by connecting them with a wiring 65 on the common substrate 6, and to short-circuit the common electrodes of even-number orders 62 by connecting them with a wiring 66 on the common substrate 6. Based on this arrangement, these common electrodes 61 and 62 may be electrically connected to the common electrode driving circuit via the first conductor 63 and the second conductor 64 at about one to four positions respectively. As a result, it becomes possible to reduce the number of connection positions at which the first and second conductors 63 and 64 are used.

Figure 8:
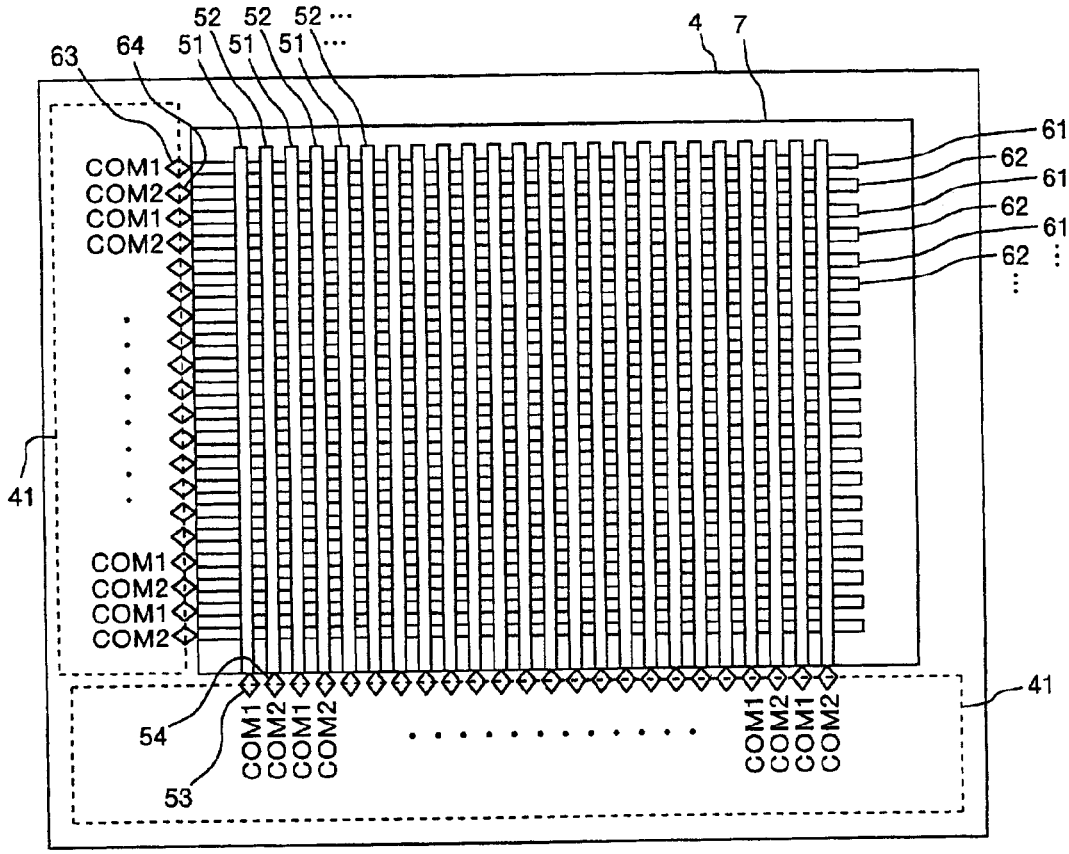
FIG. 8 is a top plan diagram that shows an outline of a liquid crystal display according to a third embodiment of the present invention.

FIG. 8 is a top plan diagram of the liquid crystal display according to a third embodiment of the present invention. The third embodiment is a combination of both structures of the first embodiment and the second embodiment. On a common substrate 7 as a second substrate, there are disposed thin linear first common electrodes 51 and 52 respectively along a plurality of data lines (not shown in the drawing) that are provided on a display section of a TFT substrate 4. At the same time, on the common substrate 7, there are also disposed thin linear second common electrodes 61 and 62 respectively along a plurality of scanning lines (not shown in the drawing) on this display section of the TFT substrate 4.

The first common electrodes 51 and 52 are insulated from the second common electrodes 61 and 62 with an inter-layer insulation film. A first common electrode of an odd-number order 51, a first common electrode of an even-number order 52, a second common electrode of an odd-number order 61, and a second common electrode of an even-number order 62 are electrically connected to a common electrode driving circuit via a first conductor 53, a second conductor 54, a third conductor 63, and a fourth conductor 64 respectively.

Other structures are the same as those of the first or second embodiment. Therefore, sections of the same structures as those of the first or second embodiment are attached with like reference numerals, and their explanation will be omitted. Further, the status of changes in the COM1, the COM2, and a voltage level of a data signal respectively is similar to that explained in FIG. 4 and the first embodiment with reference to FIG. 4.

According to the third embodiment, when the first common electrodes 51 and 52 are used as the common electrodes, it is possible to realize the common inversion driving system and the lengthwise line inversion driving system at the same time. On the other hand, when the second common electrodes 61 and 62 are used as the common electrodes, it is possible to realize the common inversion driving system and the crosswise line inversion driving system at the same time. Therefore, based on a selection of any type of the common electrodes, flicker is reduced and it becomes possible to obtain satisfactory display quality in a large-screen and high-precision liquid crystal display.

Although not particularly shown in the drawings, it is possible to mutually short-circuit the first common electrodes of odd-number orders 51 on the common substrate 7, and to mutually short-circuit the first common electrodes of even-number orders 52 on the common substrate 7. Based on this arrangement, these first common electrodes 51 and 52 may be electrically connected to the common electrode driving circuit via the first conductor 53 and the second conductor 54 at about one to four positions respectively. This similarly applies to the second common electrodes 61 and 62. As a result, it becomes possible to reduce the number of connection positions at which the first to fourth conductors 53, 54, 63 and 64 are used.

The application of the present invention is not limited to a liquid crystal display that uses polysilicon TFT's, and it is also possible to apply the invention to other active matrix type liquid crystal displays.

According to the present invention, a common electrode voltage that is applied to a common electrode of an odd-number order and a common electrode voltage that is applied to a common electrode of an even-number order are inverted to match the polarity inversion period respectively, by the common electrode driving circuit. Therefore, based on the realization of a common inversion driving system, it becomes possible to make smaller the amplitude of the voltage supplied to the data lines. Consequently, it is possible to construct the data line driving circuit with elements of a low withstanding voltage. As a result, there is an effect that it is possible to reduce power consumption and to reduce cost.

Further, the common electrode voltage that is applied to a common electrode of an odd-number order and the common electrode voltage that is applied to a common electrode of an even-number order have polarities that are inverted by the common electrode driving circuit. Therefore, the polarities of the voltages applied to the adjacent pixels are inverted. As a result, there is an effect that flicker is reduced, and it is possible to obtain high display quality with in a large-screen and high-precision liquid crystal display.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A liquid crystal display comprising:

a first substrate on which pixel electrodes and thin film transistors are disposed in a matrix shape of m rows and n columns;

a second substrate on which a plurality of common electrodes are disposed in a stripe shape corresponding to the n columns of electrodes;

a liquid crystal layer provided between said first substrate and said second substrate;

a common electrode driving circuit provided on said first substrate on which are disposed said thin film transistors, and which applies mutually-inverted voltages to said common electrodes of odd-number orders and to said common electrodes of even-number orders respectively;

first conductors which electrically connect to said common electrodes of odd-number orders, respectively, to said common electrode driving circuit in order to apply a voltage generated by said common electrode driving circuit to said common electrodes of odd-number orders; and second conductors which electrically connect to said common electrodes of even-number orders, respectively, to said common electrode driving circuit in order to apply a voltage generated by said common electrode driving circuit to said common electrodes of even-number orders.

2. The liquid crystal display according to claim 1, wherein said common electrode driving circuit inverts voltages to be applied to said common electrodes, at a predetermined interval.

3. The liquid crystal display according to claim 1, wherein said common electrodes of odd-number orders are electrically connected to each other on said second substrate, and said common electrodes of even-number orders are electrically connected to each other on said second substrate.

4. A liquid crystal display comprising:

a first substrate on which pixel electrodes and thin film transistors are disposed in a matrix shape of m rows and n columns;

a second substrate on which a plurality of common electrodes are disposed in a stripe shape corresponding to the m rows of electrodes;

a liquid crystal layer provided between said first substrate and said second substrate;

a common electrode driving circuit provided on said first substrate on which are disposed said thin film transistors, and which applies mutually-inverted voltages to said common electrodes of odd-number orders and to said common electrodes of even-number orders respectively;

first conductors which electrically connect to said common electrodes of odd-number orders, respectively, to said common electrode driving circuit in order to apply a voltage generated by said common electrode driving circuit to said common electrodes of odd-number orders; and second conductors which electrically connect to said common electrodes of even-number orders, respectively, to said common electrode driving circuit in order to apply a voltage generated by said common electrode driving circuit to said common electrodes of even-number orders.

5. The liquid crystal display according to claim 4, wherein said common electrode driving circuit inverts voltages to be applied to said common electrodes, at a predetermined interval.

6. The liquid crystal display according to claim 4, wherein said common electrodes of odd-number orders are electrically connected to each other on said second substrate, and said common electrodes of even-number orders are electrically connected to each other on said second substrate.

7. A liquid crystal display comprising:

a first substrate on which pixel electrodes and thin film transistors are disposed in a matrix shape of m rows and n columns;

a second substrate on which a plurality of first common electrodes are disposed in a stripe shape corresponding to the n columns of electrodes, and also a plurality of second common electrodes are disposed in a stripe shape corresponding to the m rows of electrodes, with said first common electrodes and said second common electrodes being insulated from each other via an insulation layer;

a liquid crystal layer provided between said first substrate and said second substrate;

a common electrode driving circuit provided on said first substrate on which are disposed said thin film transistors, and which applies mutually-inverted voltages to said first common electrodes of odd-number orders and to said first common electrodes of even-number orders respectively, or which applies mutually-inverted voltages to said second common electrodes of odd-number orders and to said second common electrodes of even-number orders respectively;

first conductors which electrically connect to said first common electrodes of odd-number orders, respectively, to said common electrode driving circuit in order to apply a voltage generated by said common electrode driving circuit to said first common electrodes of odd-number orders;

second conductors which electrically connect to said first common electrodes of even-number orders, respectively, to said common electrode driving circuit in order to apply a voltage generated by said common electrode driving circuit to said first common electrodes of even-number orders;

third conductors which electrically connect to said second common electrodes of odd-number orders, respectively, to said common electrode driving circuit in order to apply a voltage generated by said common electrode driving circuit to said second common electrodes of odd-number orders; and fourth conductors which electrically connect to said second common electrodes of even-number orders, respectively, to said common electrode driving circuit in order to apply a voltage generated by said common electrode driving circuit to said second common electrodes of even-number orders.

8. The liquid crystal display according to claim 7, wherein said common electrode driving circuit inverts voltages to be applied to said common electrodes, at a predetermined interval.

9. The liquid crystal display according to claim 7, wherein said common electrodes of odd-number orders are electrically connected to each other on said second substrate, and said common electrodes of even-number orders are electrically connected to each other on said second substrate.

* * * * *

UNITED STATES PATENT AND TRADEMARK OFFICE

CERTIFICATE OF CORRECTION

PATENT NO. : 7,006,064 B2
APPLICATION NO. : 10/102453
DATED : February 28, 2006
INVENTOR(S) : Hiromi Enomoto et al.

It is certified that error appears in the above-identified patent and that said Letters Patent is hereby corrected as shown below:

On the Title Page (under (73) Assignee):

Delete "Sharp Corporation" and insert --Sharp Kabushiki Kaisha--.

Signed and Sealed this

Tenth Day of July, 2007

JON W. DUDAS
*Director of the United States Patent and Trademark Office*